US007731058B2

(12) United States Patent
Stamatis Filho et al.

(10) Patent No.: US 7,731,058 B2
(45) Date of Patent: Jun. 8, 2010

(54) SEMI-AUTOMATIC DISPENSER FOR DISPOSABLE CUPS

(76) Inventors: Reynaldo Stamatis Filho, Rua Miguel Mauricio da Rocha, 279, Brooklin Velho, 04622-031 Sao Paulo/SP (BR); Mauro Moreira De Lima, Rua Angelo della betta, 230, Jardim Maua, 09340-310 Maua/SP (BR); Luciano Missurini, Rua Domiciano Rossi, 246 Apto. 114, Jardim Chacara Inglesa, 09726-121 Sao Bernardo Do Campo/SP (BR)

( * ) Notice: Subject to any disclaimer, the term of this patent is extended or adjusted under 35 U.S.C. 154(b) by 881 days.

(21) Appl. No.: 10/581,225

(22) PCT Filed: Nov. 29, 2004

(86) PCT No.: PCT/BR2004/000238

§ 371 (c)(1),
(2), (4) Date: Jun. 2, 2006

(87) PCT Pub. No.: WO2005/053469

PCT Pub. Date: Jun. 16, 2005

(65) Prior Publication Data

US 2008/0284291 A1 Nov. 20, 2008

(30) Foreign Application Priority Data

Dec. 5, 2003 (BR) ..... 0305003
Nov. 17, 2004 (BR) ..... 0405043

(51) Int. Cl.

| | |
|---|---|
| ***B65H 3/28*** | (2006.01) |
| ***G07F 11/16*** | (2006.01) |
| ***A47F 1/04*** | (2006.01) |
| ***B65D 83/08*** | (2006.01) |
| ***B65G 1/16*** | (2006.01) |

(52) U.S. Cl. ..... 221/221; 221/303; 221/268; 221/276; 221/251; 221/223; 221/255; 221/283; 221/152; 312/44; 312/43; 194/247; 194/257

(58) Field of Classification Search ..... 312/44, 312/43; 221/221, 152, 303, 268, 276, 251, 221/223, 233, 255, 283; 194/247, 257
See application file for complete search history.

(56) References Cited

U.S. PATENT DOCUMENTS

| | | | | |
|---|---|---|---|---|
| 1,666,008 | A * | 4/1928 | Graffenberger | 221/221 |
| 1,742,937 | A * | 1/1930 | Schampel | 15/150 |
| 1,964,335 | A * | 6/1934 | Wessman | 221/195 |
| 2,000,008 | A * | 5/1935 | Barbieri | 221/223 |
| 2,004,520 | A * | 6/1935 | Conti | 221/223 |
| 2,139,433 | A * | 12/1938 | Bares | 221/154 |

(Continued)

FOREIGN PATENT DOCUMENTS

FR 2657853 A * 8/1991

*Primary Examiner*—Gene O. Crawford
*Assistant Examiner*—Rakesh Kumar
(74) *Attorney, Agent, or Firm*—Collard & Roe, P.C.

(57) ABSTRACT

Semi-automatic dispenser for disposable cups, comprising a semi-automatic dispensing mechanism (1-50), defined by a box (2-51) having in its upper section a tubular drawer (4-43) for the accommodation of several common disposable cups (C), arranged as a stack with their mouths facing downwards, and further, each cup is expected to be dispensed in a bottom drawer (6-62).

4 Claims, 15 Drawing Sheets

U.S. PATENT DOCUMENTS 2,834,511 A * 5/1958 Booth ..... 221/116
2,880,907 A * 4/1959 Mainers ..... 221/299
3,768,694 A * 10/1973 Miller ..... 221/221
4,742,937 A * 5/1988 Blom ..... 221/223
4,858,783 A * 8/1989 Mayfield, III ..... 221/59
5,577,590 A * 11/1996 Salda ..... 194/209
5,702,029 A * 12/1997 Yang ..... 221/221

* cited by examiner

SEMI-AUTOMATIC DISPENSER FOR DISPOSABLE CUPS

CROSS REFERENCE TO RELATED APPLICATIONS

Applicants claim priority under 35 U.S.C. §119 of Brazilian Application No. PI 0305003-3 filed on Dec. 5, 2003; and Brazilian Application No. PI 0405043-6 filed on Nov. 17, 2004. Applicant also claims priority under 35 U.S.C. §365 of PCT/BR2004/000238 filed on Nov. 29, 2004. The international application under PCT article 21(2) was published in English.

FIELD OF INVENTION

The present invention refers to a semi-automatic dispensing device for disposable cups, that can be manufactured in different dimensionings, in order to deal with the currently existent different sizes of disposable cups.

DESCRIPTION OF THE PRIOR ART

As known by those entitled in this technique, nowadays devices for the above mentioned purpose are already available, but all of them are completely manual and are designed in form of a simple vertical tube, as disclosed in the documents U.S. Pat. No. 4,239,125—U.S. Pat. No. 5,067,633—U.S. Pat. No. 5,201,869—U.S. Pat. No. 5,222,628—U.S. Pat. No. 5,709,316—U.S. Pat. No. 6,325,243 and U.S. Pat. No. 6,789,697. According to these documents, almost all these devices comprise a body exhibiting a tubular shape which, actually, is a compartment for a certain quantity of cups, which remain one inside the others, forming a vertical stack of cups turned with their mouths facing downwards or not, where the first cup remains partially and sufficiently exposed, so that it can be pulled down by the user, and, together with a system of clamps, this bottom cup is released, whilst the others remain confined in the mentioned tubular compartment.

On the other hand, other more complex cups dispensing devices are available, so as disclosed in the documents U.S. Pat. No. 6,398,072—U.S. Pat. No. 6,474,503—U.S. Pat. No. 6,772,908 and U.S. Pat. No. 6,427,868. In these cases, beyond the tubular compartment for the cups, each device offers a different manner in which the cup can be pulled outside, whilst the others remain in the inner section of the device.

There is no doubt that the above mentioned devices enable a certain quantity of cups to be maintained available for the user, but they exhibit some restrictions and inconveniences. First of all, their operational system so as the compartment where the cups are stored are half-open, and the cups remain exposed to the conditions of the environment. Consequently, this fact impairs the adequate hygienic aspect of the above mentioned cups as they are maintained available for the users. Besides, in certain situations the ensemble can be considered inadequate, mainly if they are used in polluted environments or places exhibiting great quantity of suspended particles, such as industrial environments. In these situations, the usual devices can not be considered adequate, since they do not offer enough protection for the cups. In addition, in the conventional models, at the moment one cup is withdrawn, the others are maintained in position only due to a system of clamps. This system can not be considered efficient, because frequently when the user tries to withdraw only one cup, several of them—or at least two—come out in an undesired manner. This is caused by the fact of the cups being fitted into each other with a certain pressure, and the system of clamps does not previously separate the cup being withdrawn from the next cup.

OBJECTIVES OF THE INVENTION

The present semi-automatic dispenser was created to solve the above mentioned inconveniences. Its first preferred concretion has as its main goal the characterization of a completely different device in comparison to the ones currently known. In this way, it exhibits a body having the shape of a semi-circular box with an upper compartment for the cups and a bottom reception for the dispensed cup. In the inner section of the mentioned box is located a diaphragm mechanism also exhibiting semi-circular shape, whose manual operation enables the dispensing of one cup at a time. The referred device is completely different when compared to the usual devices used for the same purpose, not only referring to its operation, but also referring to the way the cups are stored. These are withdrawn one by one by means of the mentioned semi-automatic mechanism, specially designed to remain completely built-in. This operation is performed through an handle having the shape of a lever interconnected with the mentioned internal diaphragm. The sliding parts enable the cup to be dispensed to be previously separated from the others. This cup is then dispensed in the bottom part of the device. When this operation is completed, the passage is shut, maintaining the whole ensemble adequately tight. Hence, a significant advantage is offered, since the compartment or drawer containing the disposable cups remains completely closed. Consequently, the ensemble can be used in any location.

Another advantage is the fact that the system comprising the sliding diaphragm is designed to perform a sequence of angular movements, where: a) the first bottom cup will be completely separated from the subsequent cup; b) the stack of cups located above the first cup will remain firmly leaned, and only one cup—or the first bottom cup—will be released; c) the first cup, separated from the others, will be released through free fall and will remain positioned so that the user can pick it up easily; and d) that diaphragm will shut again the opening through which the cup was released, maintaining the inner section of the device completely isolated from the environment, avoiding inclusively the penetration of insects.

Although the above mentioned device exhibits an efficient operation, it was noted that its body exhibiting semi-circular shape, and also the diaphragm mechanism equally semi-circular, could be considerably improved. Due to the fact that in its preferred concretion, both body and diaphragm exhibit a semi-circular shape. This fact demands numberless special constructive details referring to the moving parts, mainly an articulation point in form of shaft for the mentioned diaphragm. Eventually, this shaft can be subjected to wearing or material fatigue.

On the other hand, the semi-circular geometry adopted for the above mentioned device, demands a diaphragm exhibiting constructive details including a great number of curved parts, mainly referring to the horseshoe shaped part, which is responsible for the separation of the first cup from the others. This part, as already mentioned, exhibits an horseshoe shape, and its side branches are curved so as to follow the semi-circular sliding movement. Consequently, this configuration impairs the component manufacturing.

With the purpose of offering a more simple device, both referring to the constructive and operational aspects, a constructive variation—or a second preferred concretion for the ensemble—was created. The same operational concept of the previous version was maintained, but a different assembling geometry was adopted, both referring the body and the diaphragm system. The body exhibits the shape of a rectangular box with small height. In its inner section slides a diaphragm exhibiting similar shape. In other words, exhibiting the shape of a simple rectangular plate, whose movement, unlike the previous one, is rectilinear. Beyond eliminating the use of a shaft, the terminals or side branches of this horseshoe shaped part are straight and parallel one in relation to the other, resulting in a more efficient configuration for the ensemble operation. As already mentioned, the diaphragm is a rectangular plate and exhibits a blind extremity over which the stack of cups remains leaned with their mouths facing downwards. The other extremity of the mentioned plate is hollowed out by an opening, which is contoured by the horseshoe shaped part. In this condition, when the mentioned plate is moved until the end of its travel, this opening is positioned exactly under the stack of cups. However, the horseshoe shaped part separates only the first cup from the others. So, the first cup is released by free fall and remains positioned to be withdrawn by the user, whilst the stack of cups remains leaned over the horseshoe shaped part. When the diaphragm is no longer operated, the strength of the spring makes it return automatically, and its blind section is positioned under the stack of cups. So, the complete device remains once more closed and ready for a new operation.

Hence, in this other preferred concretion, the modifications were created so that the mobile parts can operate through straight movements. Consequently, the ensemble efficiency is considerably improved, mainly due to the fact that the mentioned diaphragm does not use one point as shaft. The straight movements request only straight guides or fittings. In this way, possible points which could eventually exhibit easy wearing were eliminated.

DESCRIPTION OF THE DRAWINGS

For a better comprehension of the present invention, bellow can be found a detailed description including references to the attached drawings, where.

DETAILED DESCRIPTION OF THE INVENTION

Figure 1:
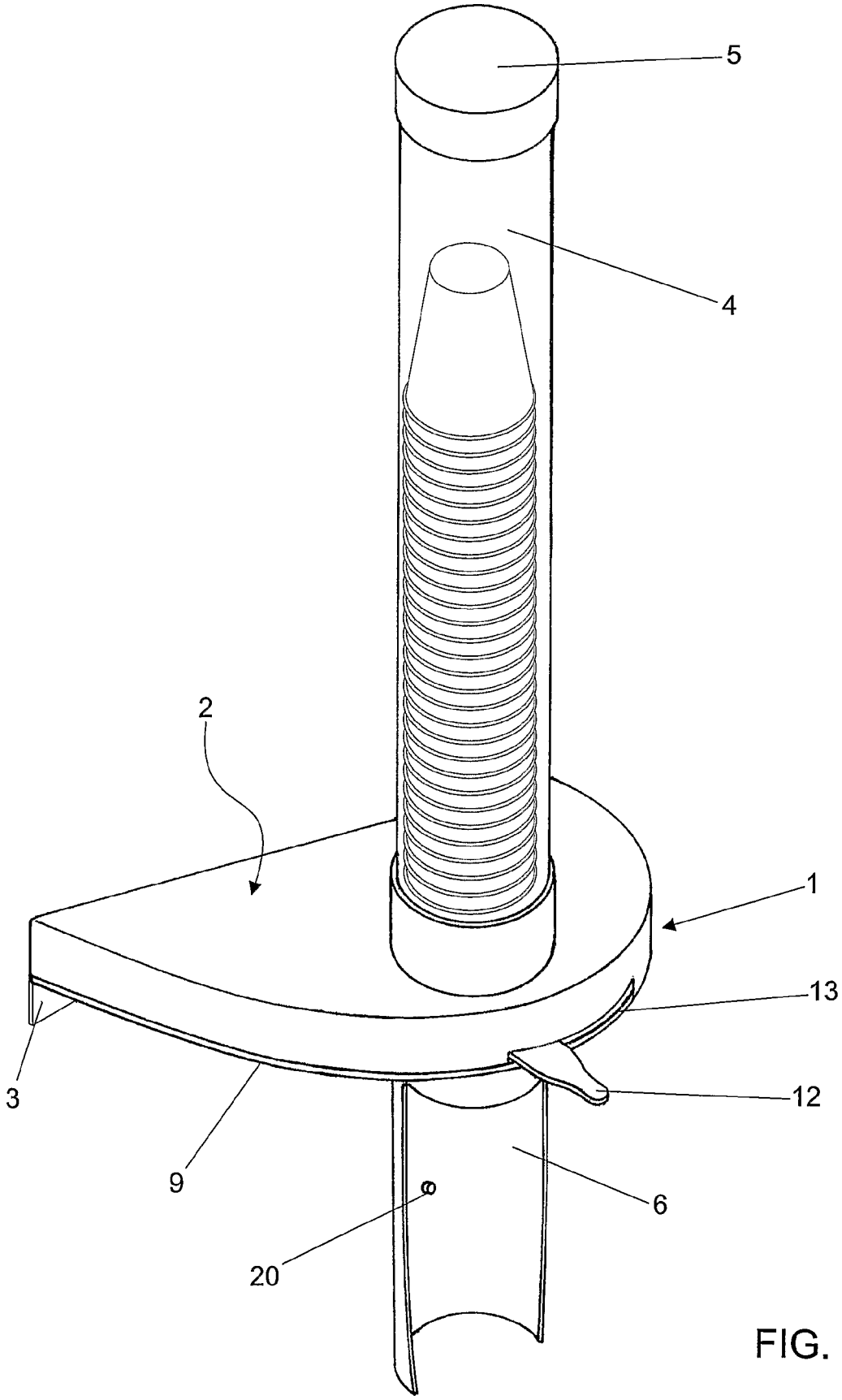
FIG. 1 represents a view in perspective showing the assembled ensemble from an upper angle.
Figure 2:
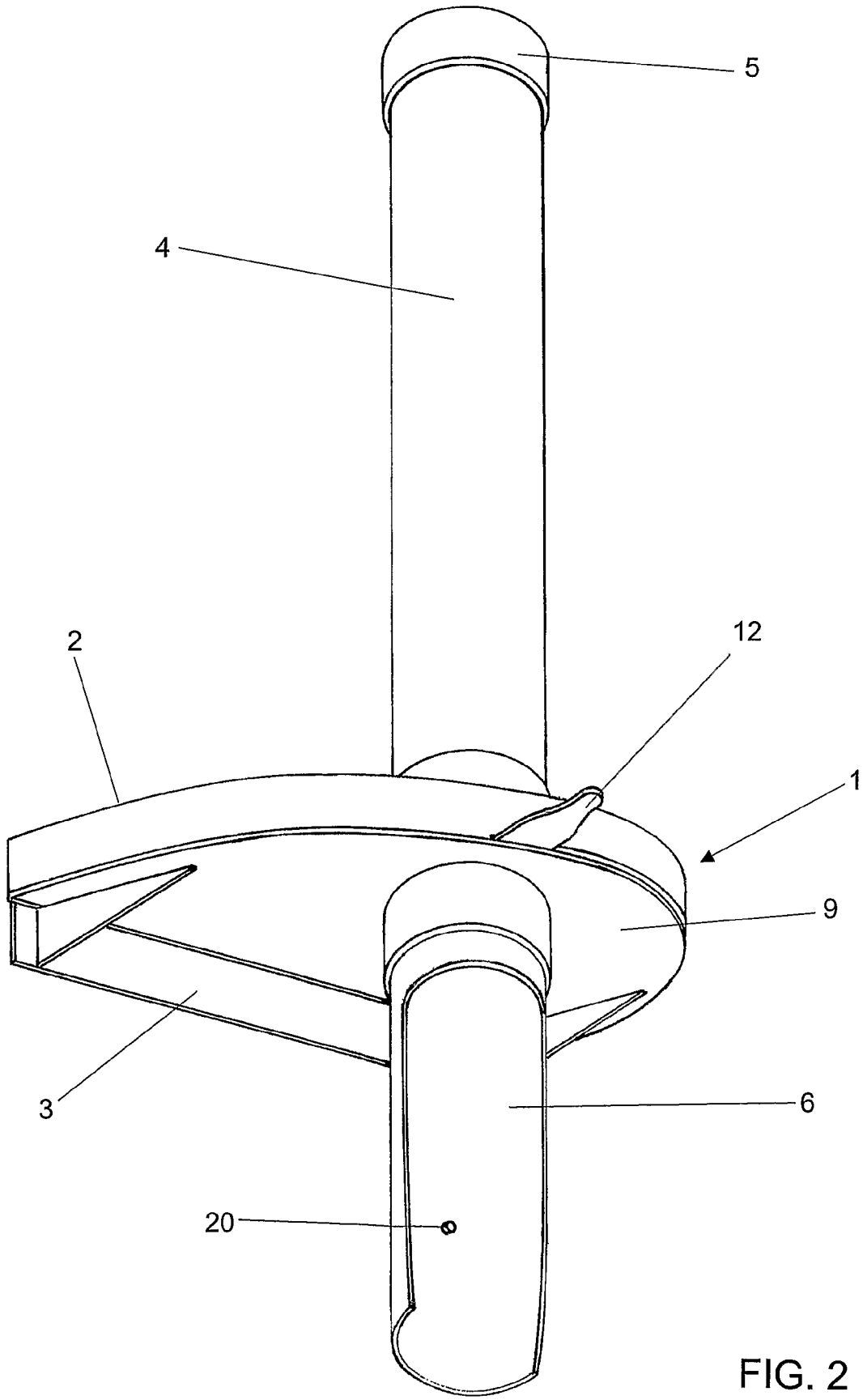
FIG. 2 represents another view in perspective of the assembled ensemble, but seen from a bottom angle.

According to the illustrated in FIGS. 1 and 2, the present invention—in its first preferred concretion—comprises a semi-automatic dispensing device (1), defined as a box (2) exhibiting an half moon or semi-circular shape, whose straight section is facing the rear side, where it includes a fastening plate (3) for the ensemble in an adequate place, whilst the curved section is facing the front. Its superior section includes a vertically assembled tubular compartment (4), which should be preferably transparent, with a top lid (5). This configures the compartment for several common disposable cups, arranged with their mouths facing downwards. The bottom of this compartment is axially aligned with another ordinarily vertical and tubular and section (6), which constitutes the exit for the cups to be dispensed by the semi-automatic dispensing device (1).

The dispensing device (1), as already mentioned, comprises one box (2) exhibiting an half moon or semi-circular shape. As represented in detail in FIGS. 3 and 4, this box includes an horizontally plane superior wall (7), semi-circular, contoured by a substantially short vertical wall (8), under which fits itself another plane section comprised of a plate exhibiting an half moon shape (9), which by its turn, closes the semi-circular box (2). Above this mentioned plate (9), exists another sliding diaphragm-plate (10) which, at its rear edge, includes an articulation bolt (11), and at its front edge exhibits an extension which configures the digital handle (12), radially projected to the outside through a slot (13) formed by a cutting in the wall (8). This cutting exhibits sufficient extension so that the mentioned diaphragm-plate (10) can be moved in an angular way from one side to the other, establishing or not the alignment between its circular opening (14) and two other circular openings (15) and (16), that exist in the wall (7) and in the closure section (9). These are respectively aligned with the tubular compartment (4) and the tubular section (6). The alignment of the opening (14) is established by the slot (13), whose length is also sufficient for the diaphragm-plate (10) to be displaced so that its blind section (17) can be placed between both circular openings (15) and (16). Over the diaphragm-plate (10) is fastened a part exhibiting an horseshoe shape (18), whose open ends or extremities—besides having their heights funnel-shaped—face the blind section (17), while in the opposite side, great part of its extension contours the mentioned opening (14). As illustrated in FIG. 5, this mentioned horseshoe (18) exhibits a special cross-section, in detail, the whole extension of its internal border is contoured by a tread or progressive advanced border (19), which is responsible for the separation of the cup to be dispensed in the inner side of the tubular section (6). This tubular section (6) exhibits the shape of an half tube, whose bottom end is narrower, and over which exists median peg (20).

Figure 6:
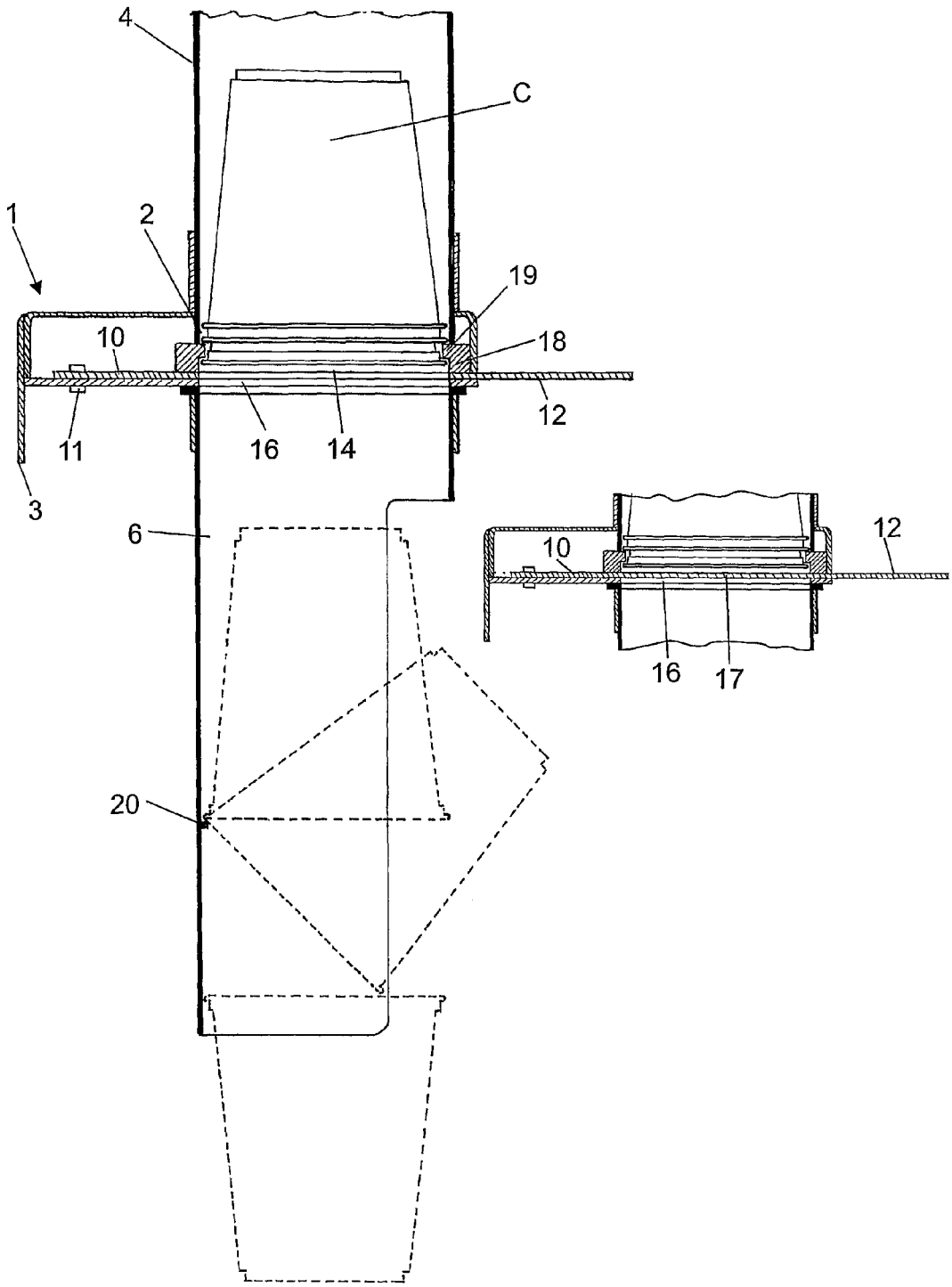
FIG. 6 represents the side view cut illustrating the operation of the ensemble.
Figure 7:
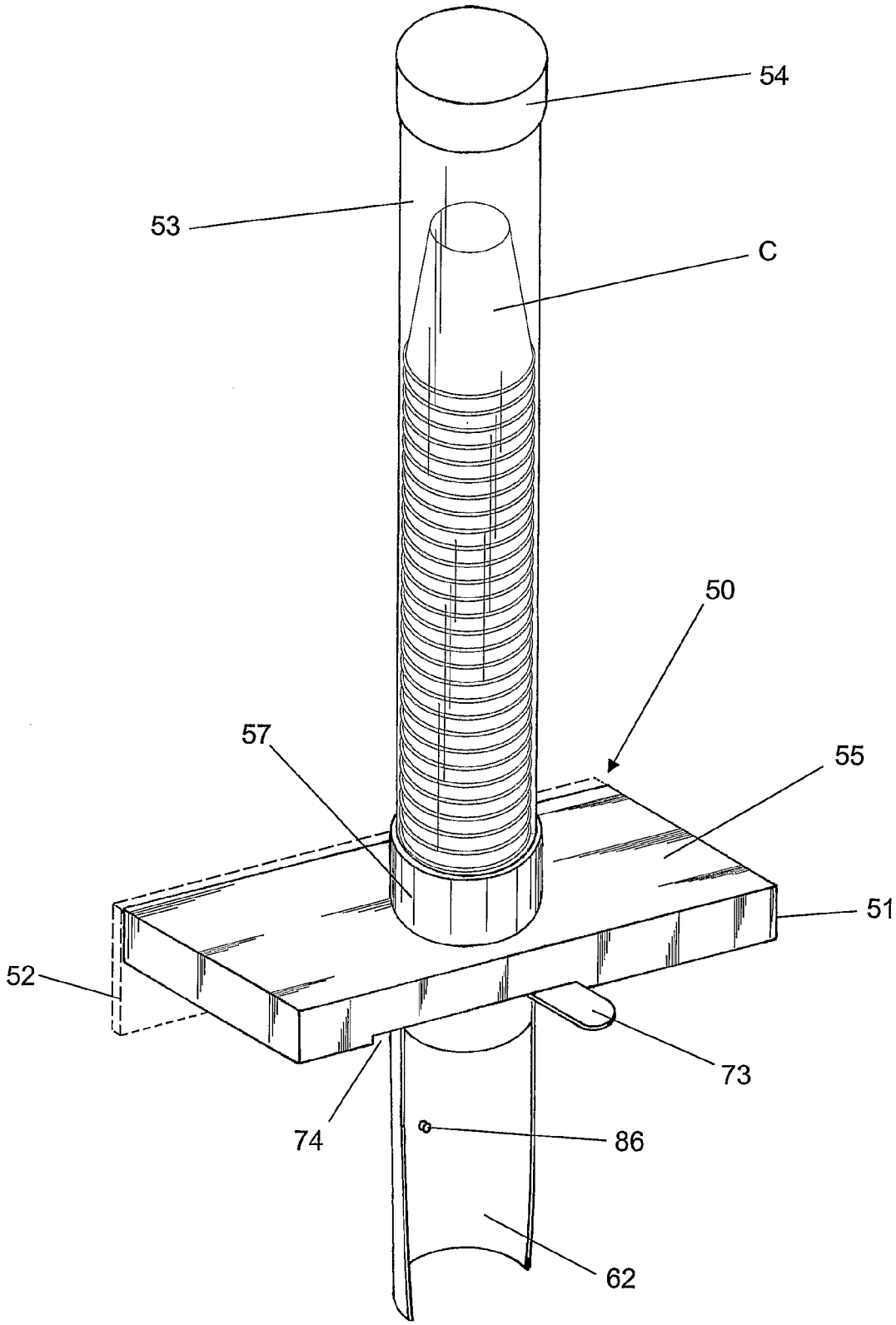
FIG. 7 represents a perspective view showing the assembled ensemble from an upper angle, according to the other preferred construction.
Figure 8:
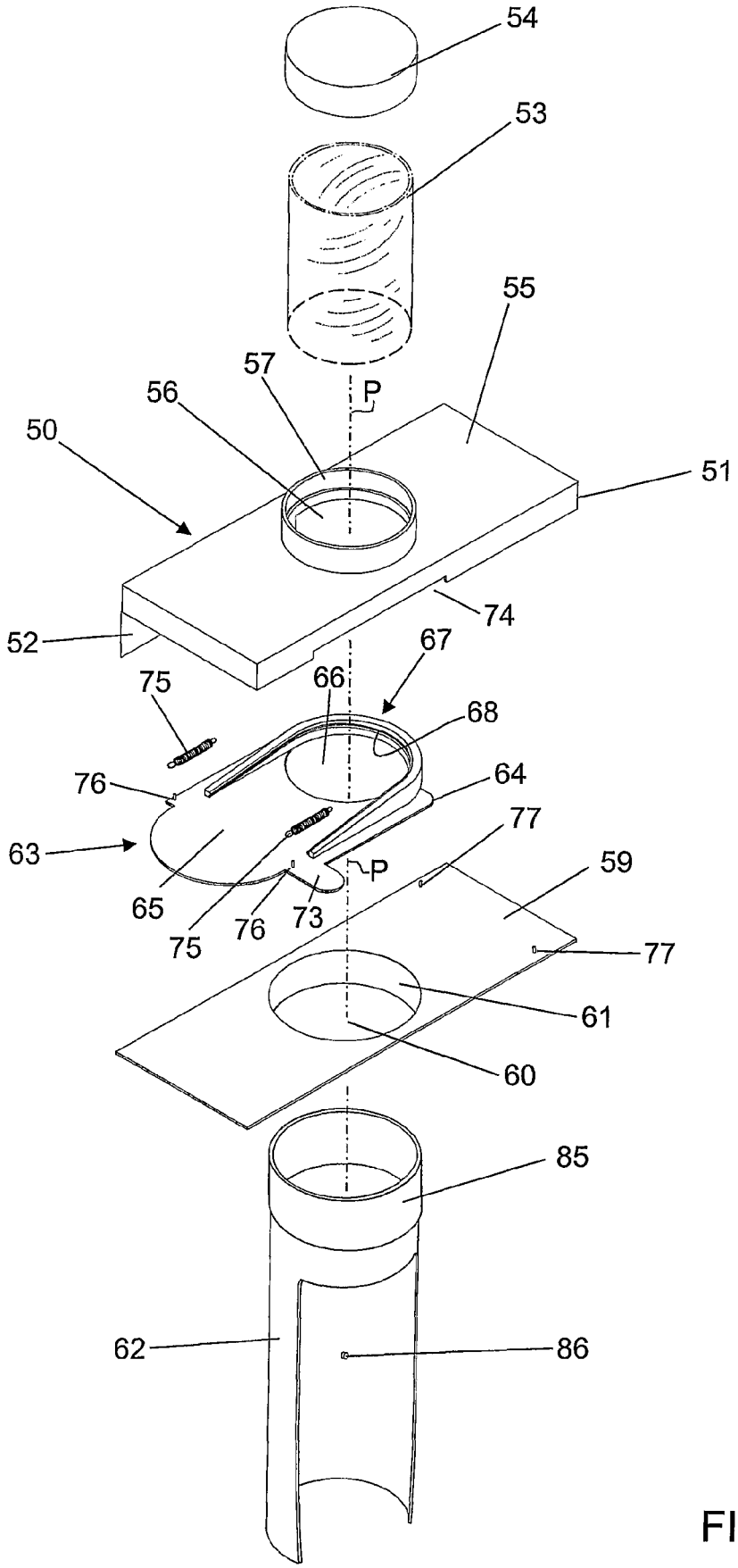
FIG. 8 illustrates an exploded perspective view of the ensemble represented in the previous figure, detaching each component from an upper angle.

As illustrated in FIG. 6, the operation of the ensemble is really simple, and the dotted lines represent the movement of the dispensed cup. Before describing this details, it is possible to observe that the cups (C) are arranged with their openings facing downwards in the inner side of the compartment (4). In a first condition, showed in the detail of FIG. 6, the diaphragm-plate (10) is displaced so that its blind section (17) is positioned over the opening (16). Consequently, the stack of cups remains leaned against this mentioned blind section (17) of the plate (10), being hindered from moving down. To dispense one cup, the mentioned diaphragm-plate (10) is displaced through its digital handle (12) until its opening (14) becomes axially aligned with the opening (16). This movement is limited by certain construction details, mainly the slot (13). During this sliding movement of the diaphragm-plate (10), the horseshoe shaped part (18) promotes the selection or simply separates the first bottom cup from the others. In other words, the border (19) fits itself between the first and second cup from the bottom to the top, forcing the first cup so that it releases itself from the cup immediately above. In this condition, the cups—or the stack of cups—remain leaned against the thread or border (19), whilst only the first cup is positioned bellow the mentioned border. When the alignment between the holes (14) and (16) is completed, the first cup is released sliding down through the length of part (6) by simple free fall, descending with its mouth downwards. But, as it touches the peg (20), it tends to turn to the outside, in a 180.degree. rotation. This occurs due to the conic shape of the mentioned cup, whose mouth exhibits a greater diameter. The cup remains inside the tubular section (6), whose bottom extremity exhibits a slight funneling, sufficient to retain the mentioned cup in the upright position, so that the user can pick it up already in the usage position.

Figure 3:
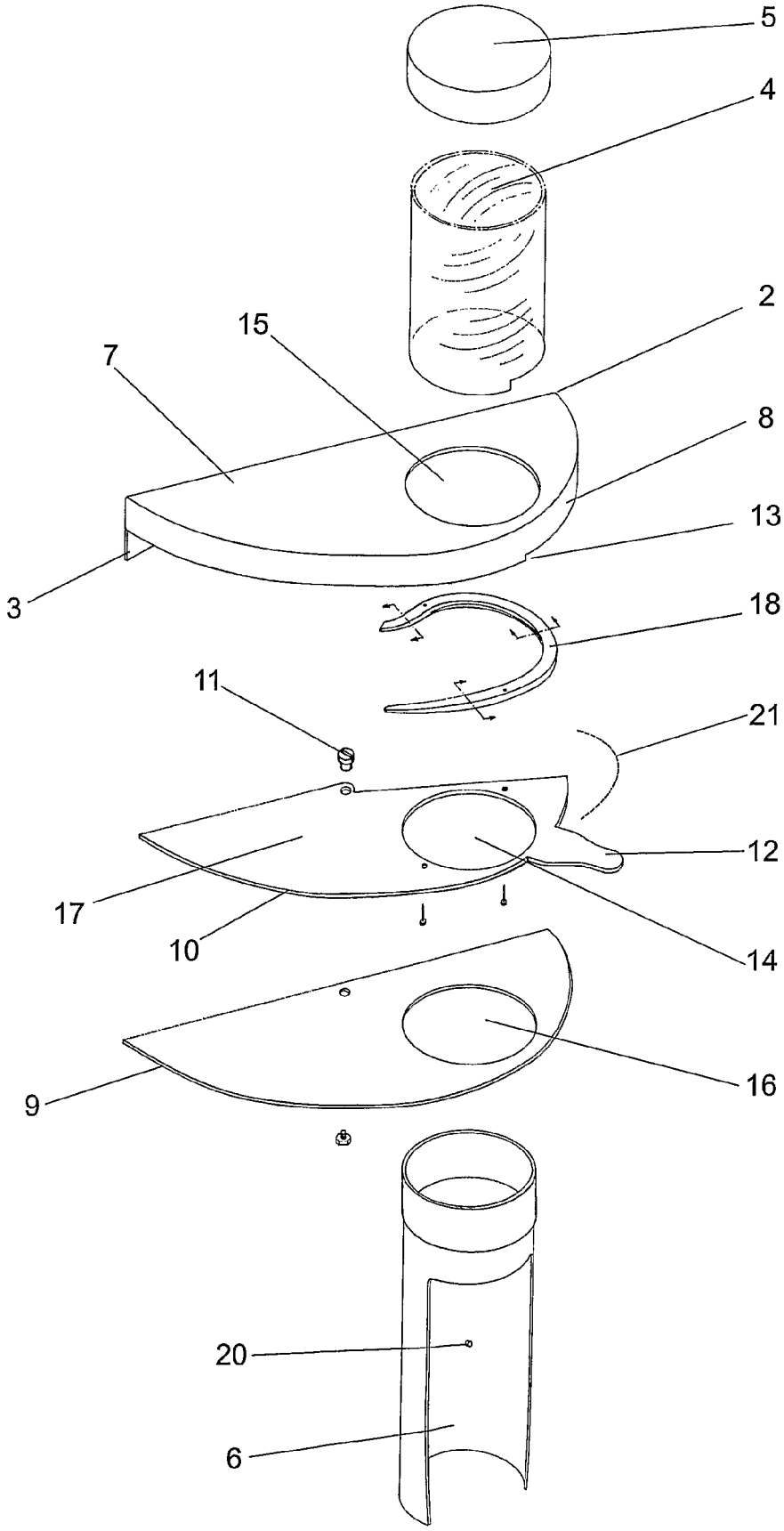
FIG. 3 illustrates an exploded perspective view, showing each component of the ensemble seen from a superior angle.
Figure 4:
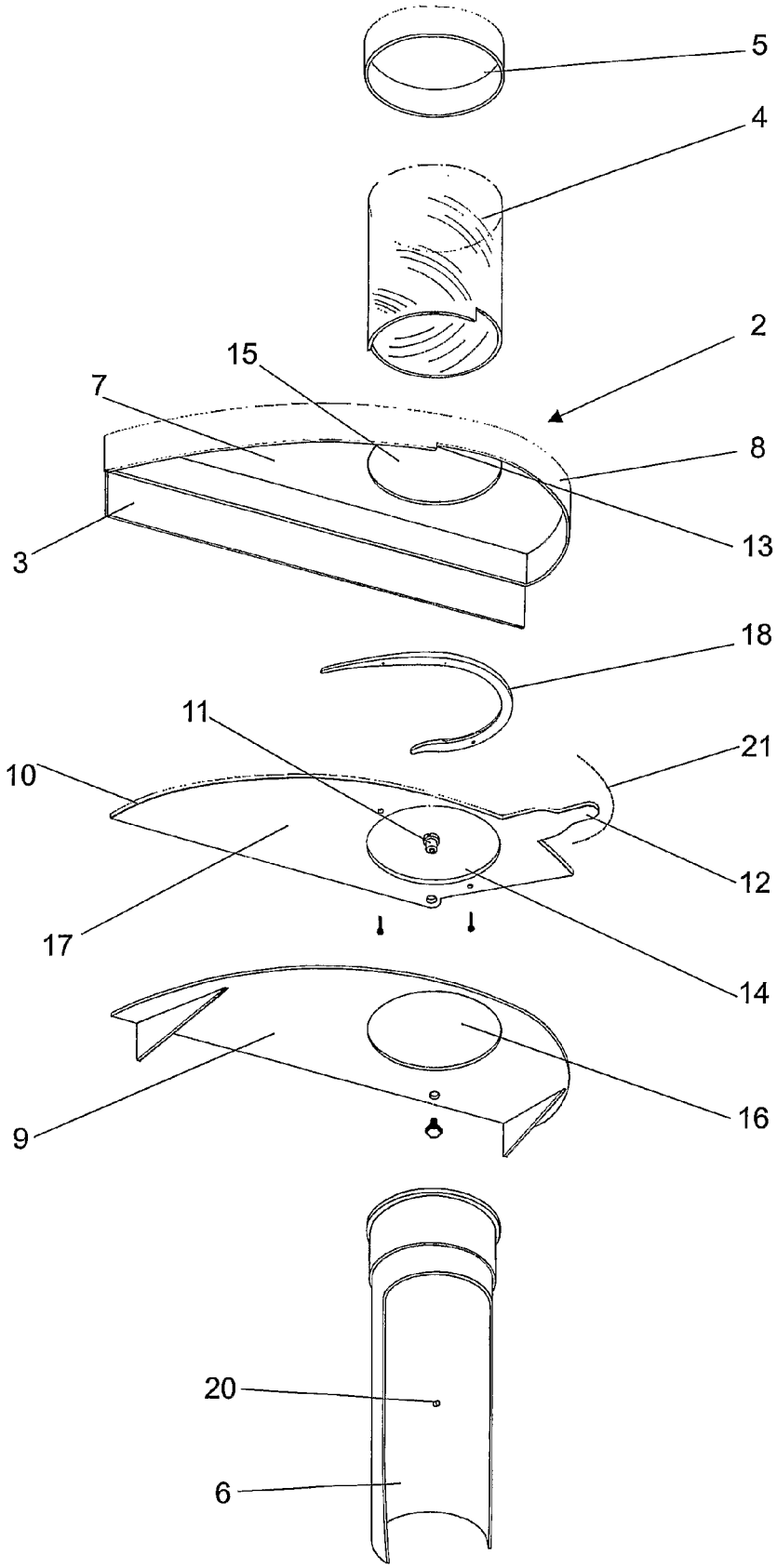
FIG. 4 illustrates another exploded perspective view, but showing each component from a bottom angle.
Figure 5:
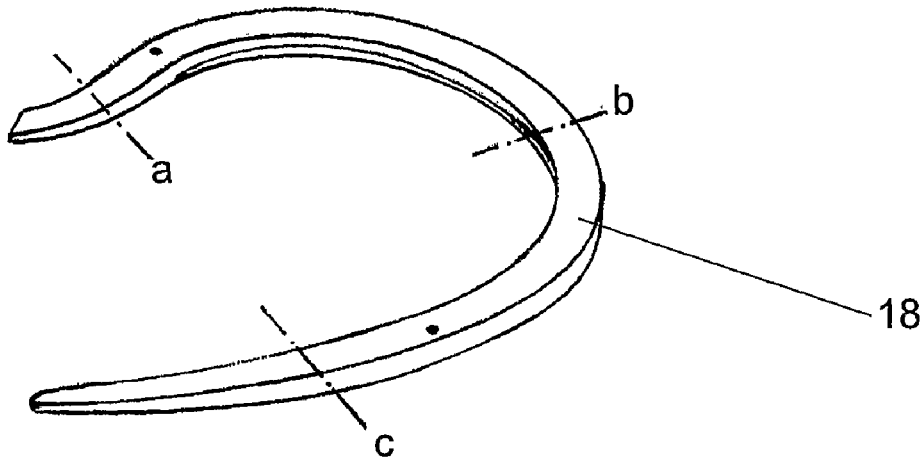
FIG. 5 shows a perspective view and cuttings detailing one part exhibiting special construction in horseshoe shape.
Figure 5:
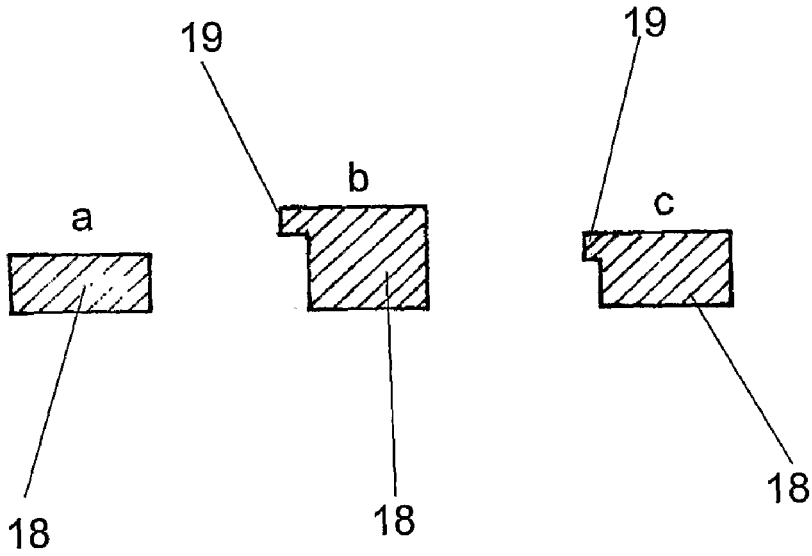

According to FIGS. 3 and 4, in an adequate point of the diaphragm-plate (10) and the inner side of the box (2) it is possible to include an adequate spring (21), which would maintain the mentioned diaphragm-plate (10) strained, so that it can be secured in the position with its blind section (17) between the openings (15-16). Consequently, in this position, the complete compartment (4) remains adequately closed, avoiding de penetration of insects and impurities.

Figure 9:
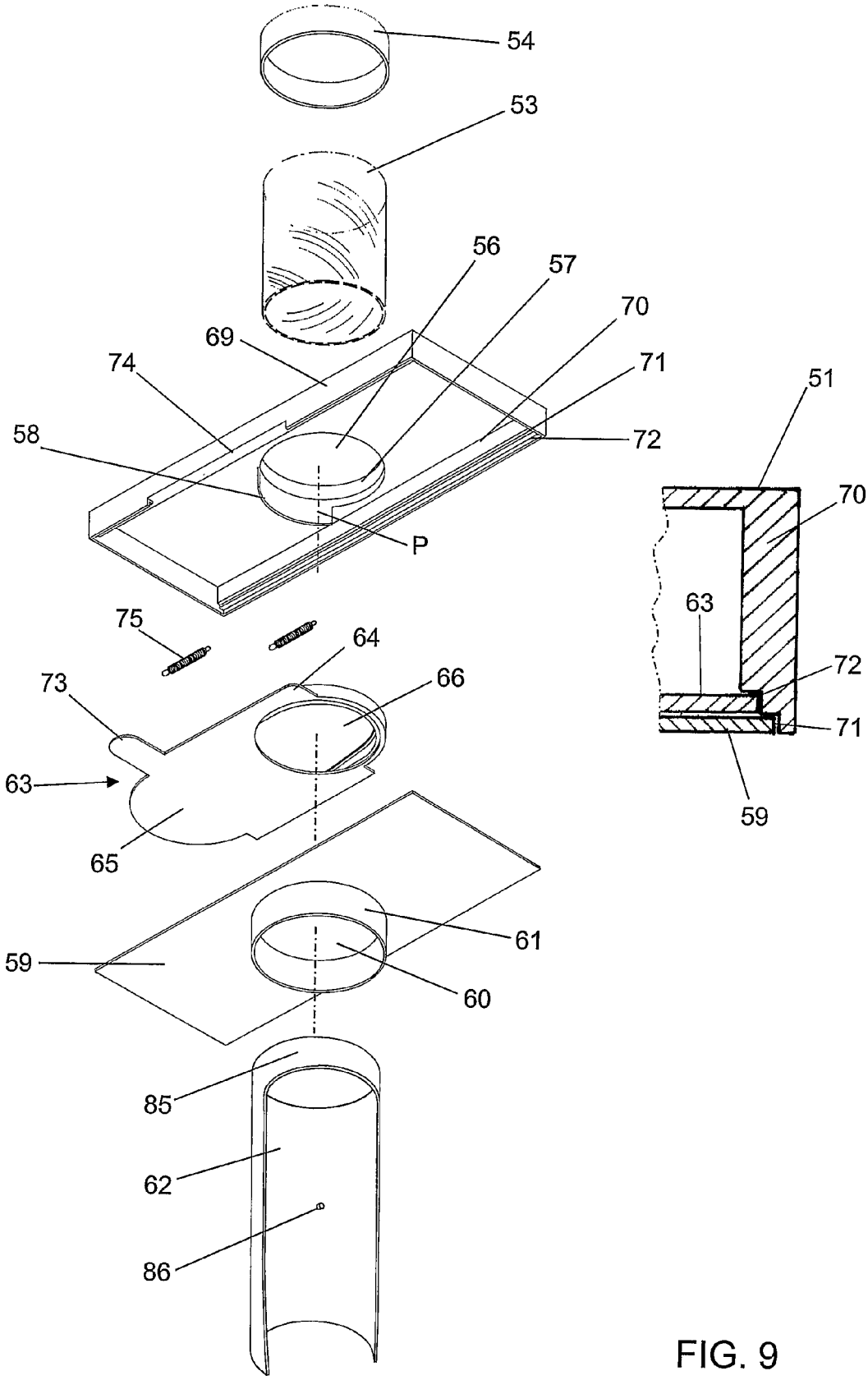
FIG. 9 is another exploded perspective view, but showing each component from a bottom angle.
Figure 10:
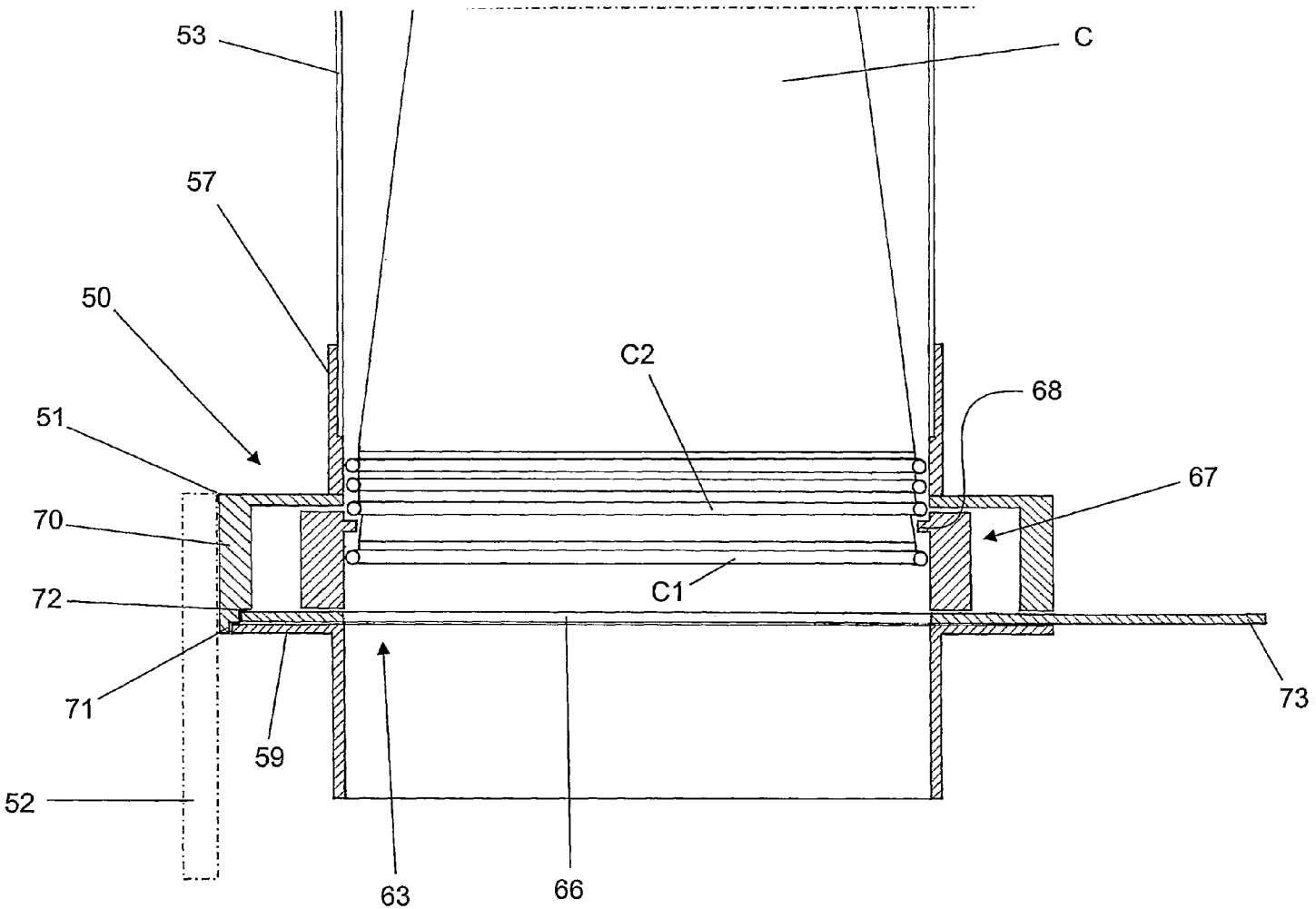
FIG. 10 illustrates a partial view in cross section, showing the internal diaphragm mechanism, according to a second preferred concretion.

FIGS. 7 to 17 show the second preferred concretion for the present dispenser. According to FIGS. 7, 8 and 9, it is possible to observe that this device is comprised of:

a) a semi-automatic dispensing mechanism (50), defined as a box (51) exhibiting parallelepipedic shape and reduced height, whose rear section includes fastening means (52) for the ensemble in appropriate place;

b) a tubular drawer (53), preferably transparent, with a top lid (54), which configures the compartment for several usual disposable cups (C), arranged in form of a stack with their mouths facing downwards;

c) the mentioned box (51) having an upper wall (55) exhibiting a central opening (56), whose upper side includes a fitting and fastening collar (57) for the corresponding extremity of the drawer (53), whilst the bottom side exhibits a semi-circular collar (58), which corresponds to the axial passage (P) for the cups (C) to be dispensed;

d) the bottom section of the box (51) is closed by a rectangular lid (59);

e) the rectangular lid (59) exhibits a circular central opening (60). One side of this opening is axially aligned with the central opening (56), whilst the bottom side includes a collar (61) forming the continuity of the passage (P)—or exit—for the cups to be dispensed by the semi-automatic dispensing device (1);

f) a receiving drawer (62) for the dispensed cups (C) exhibiting an ordinary tubular shape, whose upper extremity is connected to the collar (61);

g) a diaphragm (63) assembled in a sliding way in the inner section of the box (51). This diaphragm is formed by a plate (64) in which one extremity exhibits a blind section (65), whilst in the opposite extremity exhibits a section with an opening (66), whose diameter is compatible with the openings (56-60) and with the mouth diameter of the cup (C) to be dispensed. The mentioned blind section (65) is cooperative so that it can be positioned in two ways, outside or between the two openings (56-60). In the second position it actuates as closing and support for the stack of cups (C) to be dispensed, whilst the opening (66) can also be positioned in two ways, outside or between the openings (56,60). In the second position occurs a perfect axial alignment between the openings (56), (60) and (66) so that the cup (C) to be dispensed is able to pass through the inner section of the receiving drawer (62);

h) an horseshoe shaped part (67) is fitted over the diaphragm (63). A portion of this horseshoe contours the opening (66) in a relation opposed to the collar (58), with which it combines to form a circular passage section (P) for the cup to be dispensed. The mentioned horseshoe exhibits cooperative internal means (68)—also shown in FIG. 10—that, concomitantly, separate the first bottom cup (C1) to be dispensed while retaining the other cups (C2) when the diaphragm (63) is moved aligning the openings (56), (60) and (66);

According to the amplified detail in FIG. 9, the bottom edges from the front (69) and rear (70) walls of the box (51) exhibit internal steps (71-72). The first one is responsible for the fitting and fastening of the lid (59) and the second forms the slider for the diaphragm (63).

The diaphragm (63), or its plate (64), exhibits a front extension configuring an handle (73), which trespasses a longitudinal slot (74) in the front wall (69). It is sufficiently exposed so that the mentioned diaphragm can be displaced in both directions, and along the sliders or step (72).

Usually the diaphragm (63) is maintained strained with its blind section (65) between the openings (56) and (60). This is achieved by two springs (75), one at each side. These springs have one of their extremities connected to pins (76) in the plate (64), whilst the opposite extremities are connected to other pins (77) in the inner section of the lid (59).

Figure 11:
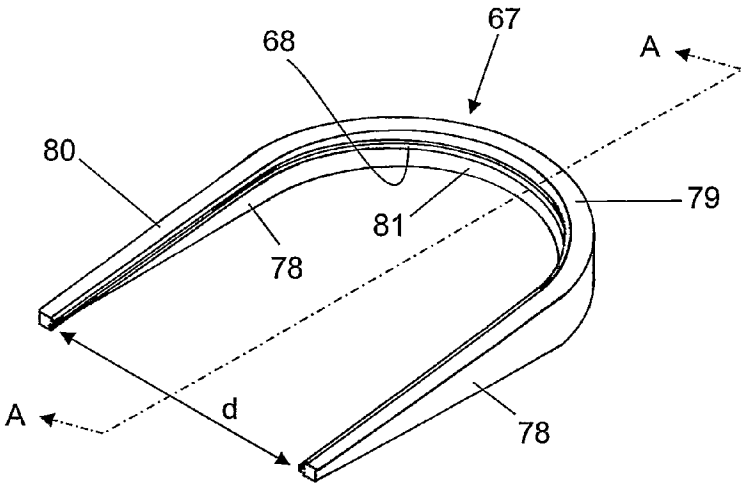
FIG. 11 shows a perspective only of the horseshoe shaped part used in the second preferred concretion.
Figure 12:
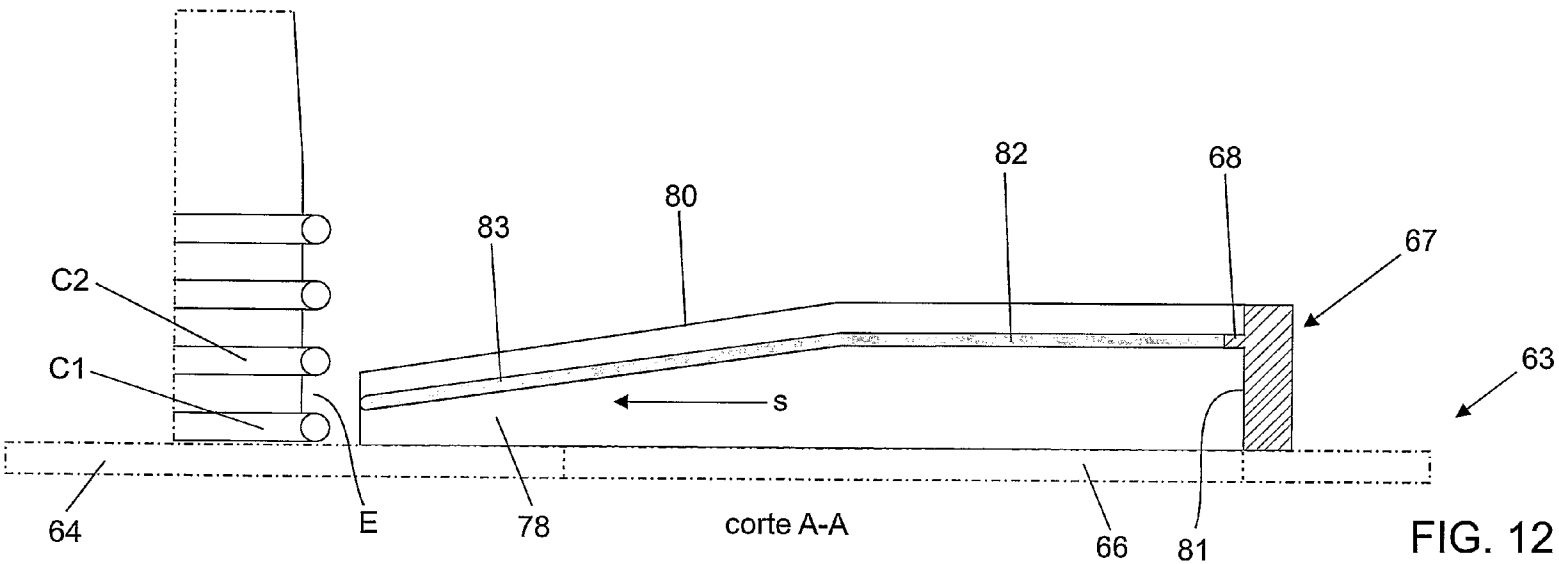
FIG. 12 shows a view of the cutting A-A indicated in the previous figure.

According to the illustrated in FIGS. 11 and 12, in a first constructive version, the horseshoe shaped part (67) has its branches (78) parallel one to the other and coinciding with the curved or semi-circular section (79). This section and the branches (78) have coplanar bottom faces. However, in the upper section, the parallel branches (78) exhibit decreasing inclined faces (80). In the inner face (81) of the mentioned horseshoe shaped part (67) are developed the means (68) for cups separation. These means exhibit the shape of a rim or rib having an horizontal section (82) which extends itself through the curve (79) and an inclined section (83) which accompanies the face (80) inclination, so that the free extremities of the sections (83) can remain aligned enabling them to penetrate as a fork in the space (E) surrounding the rounded borders between the first cup (C1) and the second cup (C2). The diaphragm (63) is moved in direction of the arrow (S), where the inclination of the sections (83) is sufficient to separate the cup (C1) from the other cups (C2) and liberate the first cup through the passage (P) whilst the others remain leaned against the rim (68).

The distance (d) between the free extremities of the sections (78) or terminals of the section (83) of the rim (68) is slightly smaller than the cups (C) diameter. The cup has its circular wall slightly pressed, sufficient to promote its displacement in relation to the next cup, favoring its release through free fall through the passage (P).

Figure 13:
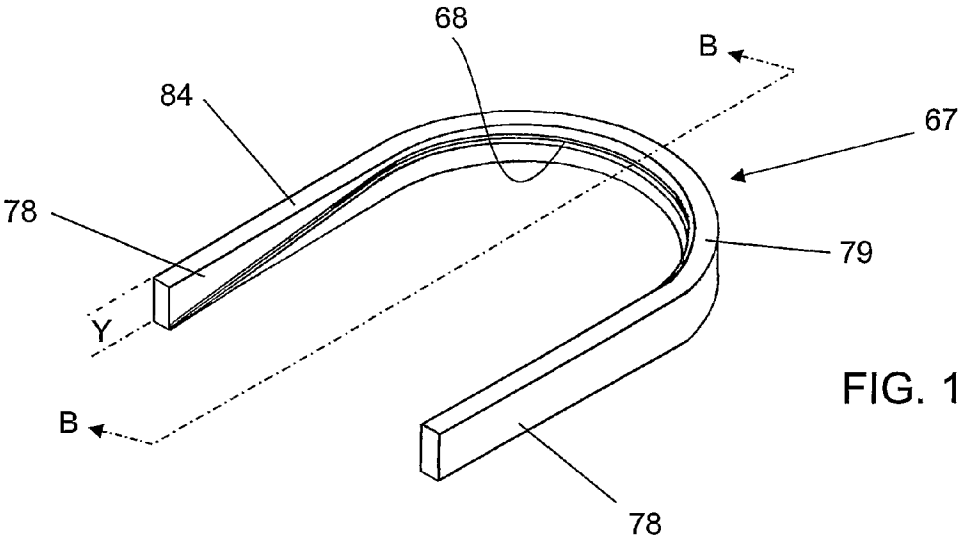
FIG. 13 shows a perspective only from the horseshoe shaped part, detaching a constructive variation.
Figure 14:
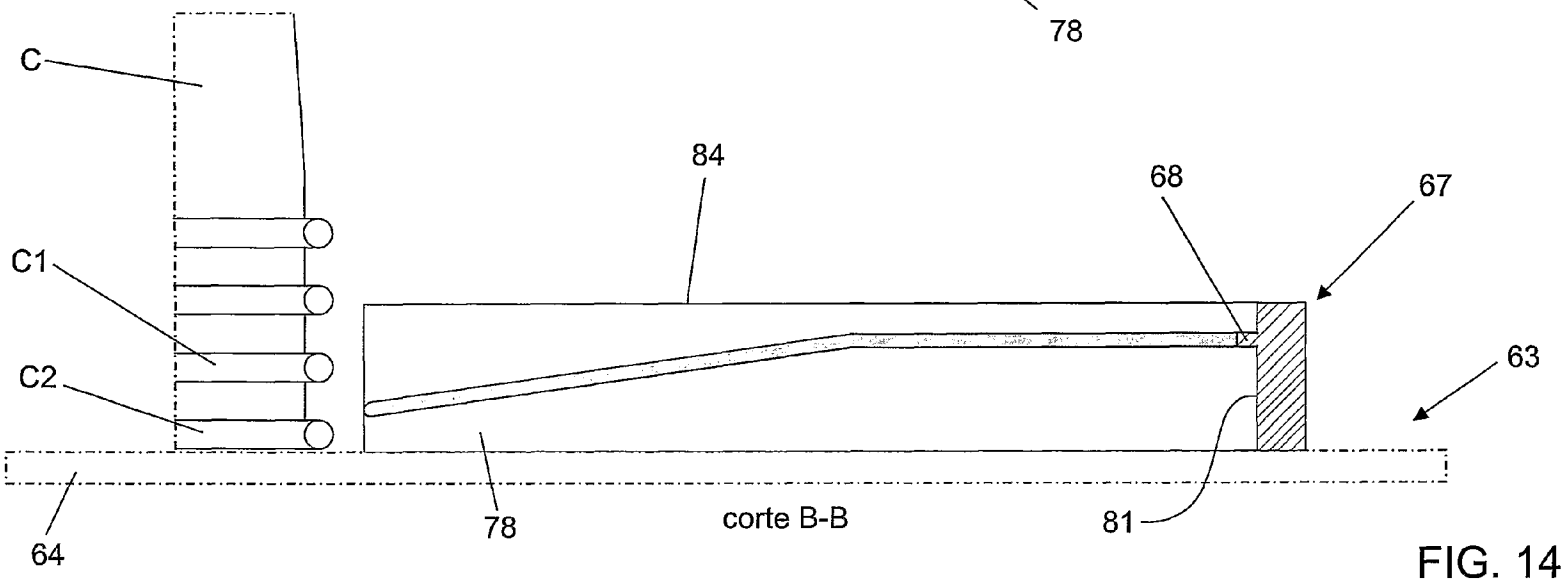
FIG. 14 shows a view of the cutting B-B indicated in the previous figure.

In relation to FIGS. 13 and 14, according to a constructive variation, the branches (78) of the horseshoe shaped part (67) exhibit their upper face (84) parallel to the bottom face, the other constructive details remaining unchanged. In this case, the height (y) renders only to guide a greater number of cups (C) during diaphragm operation (63).

Figure 15:
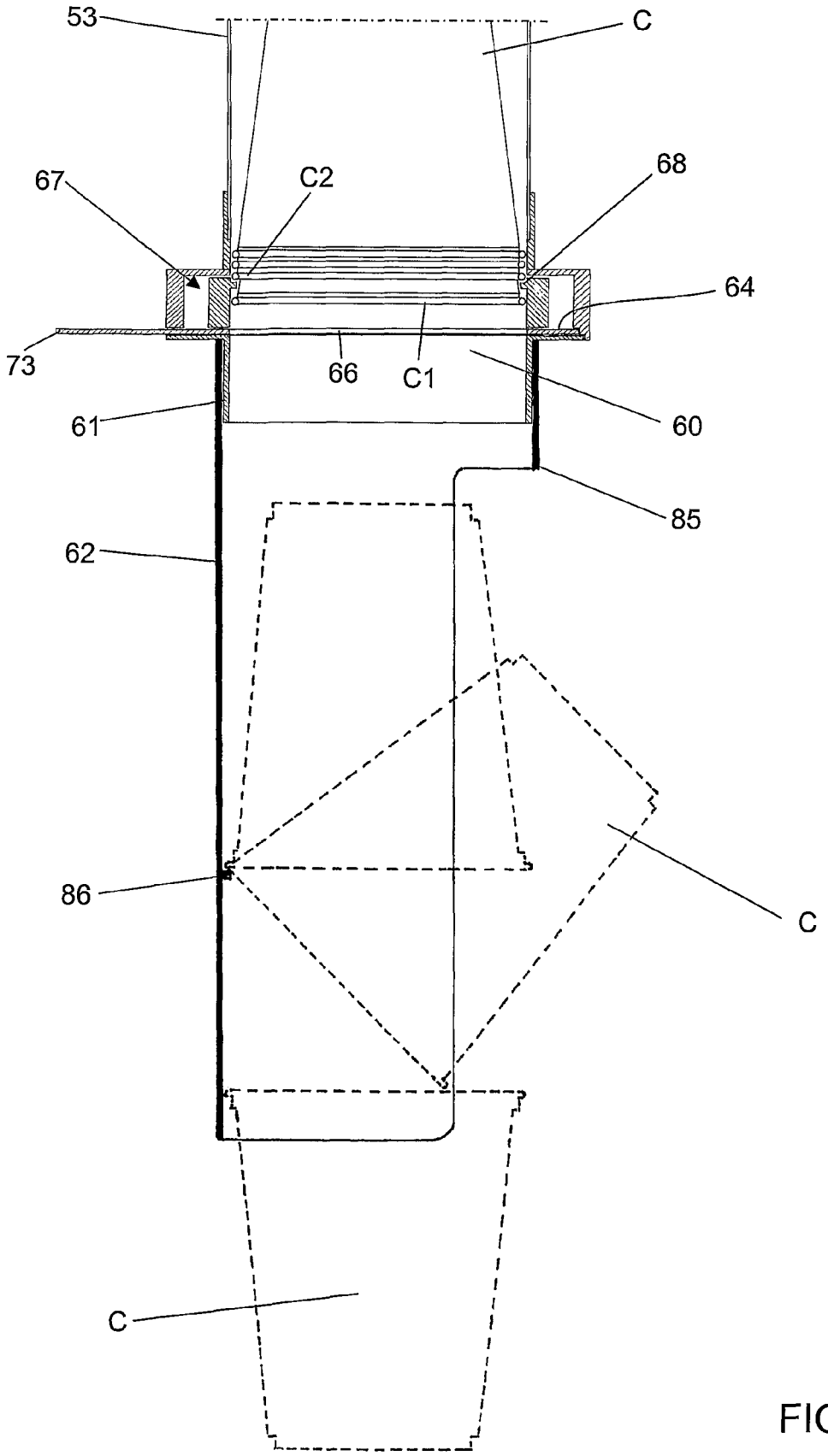
FIG. 15 represents a side view illustrating the operation of the ensemble and, in this case, detaching the movement performed by the dispensed cup according to the second preferred concretion.

According to the illustrated in FIG. 15, the upper extremity of the drawer (62) exhibits a tubular shape (85) to be connect to the collar (61). Under this section (85), it exhibits a longitudinal cut having semi-circular shape, but with a sufficient radius that enables the greater diameter (mouth) of the cup (C) to be maintained imprisoned, whilst its smaller diameter (bottom) is launched to the outside. This occurs when the mentioned cup touches a median peg (86) that can be found in the inner section of the drawer (62), where the mentioned cup suffers a 180° rotation and is maintained in this position in the bottom extremity of the mentioned drawer (62). With this purpose, the bottom extremity of the drawer exhibits a slightly smaller diameter than the greater diameter of the cup (C), so that the cup remains with its mouth slightly fastened by this bottom extremity of the drawer (62), whilst the rest of its body remains exposed, so to be easily removed by the user.

Eventually the holder (52) can be integrated with a pedestal or base (not illustrated), enabling the ensemble to be placed over any plane instead of being fastened to a wall. However, this and other modifications will not interfere in the basic configuration of the ensemble.

Figure 16:
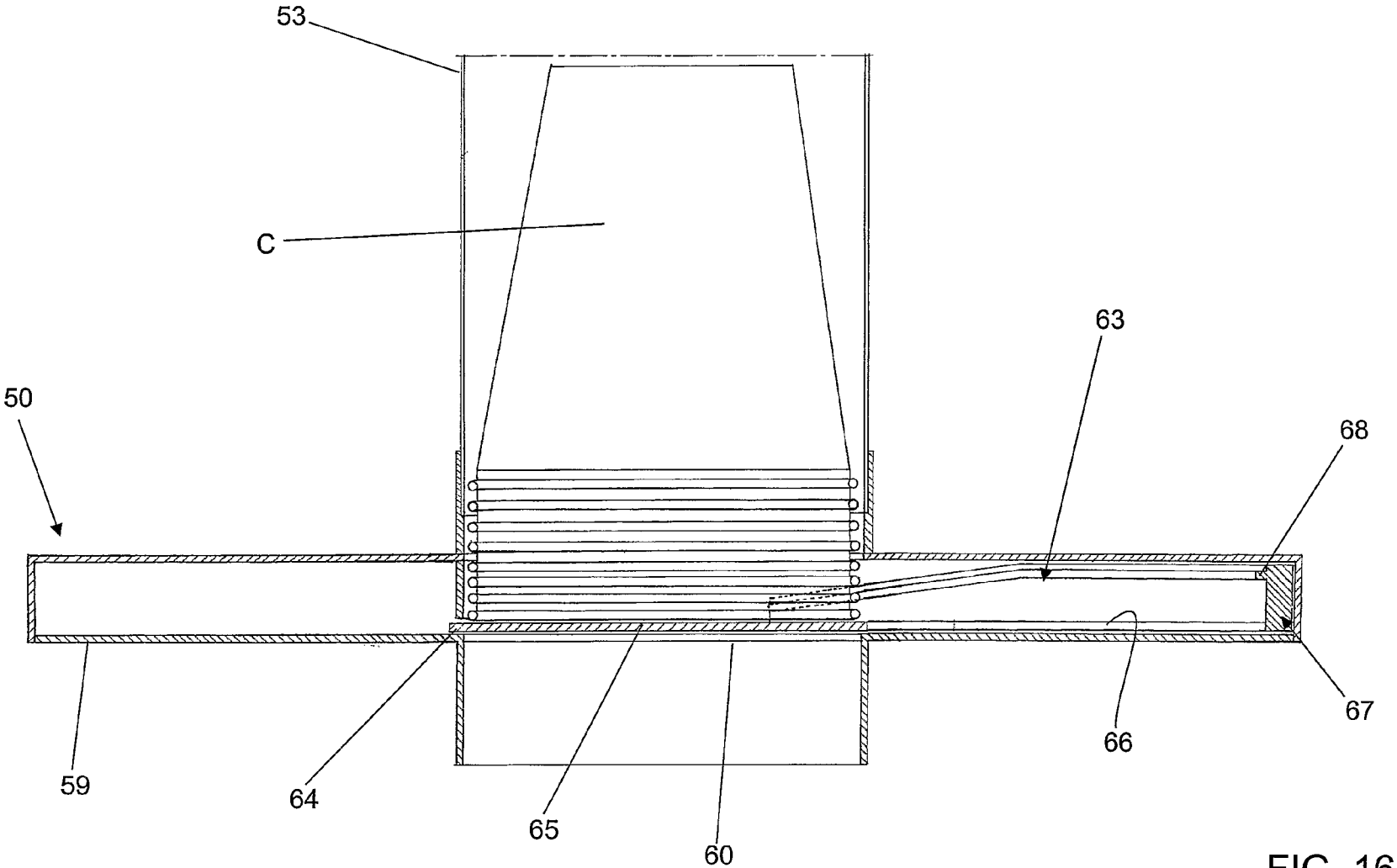
FIG. 16 shows a side longitudinal cut view, detaching the device in inactivity—or not operated—referring to the second preferred concretion.
Figure 17:
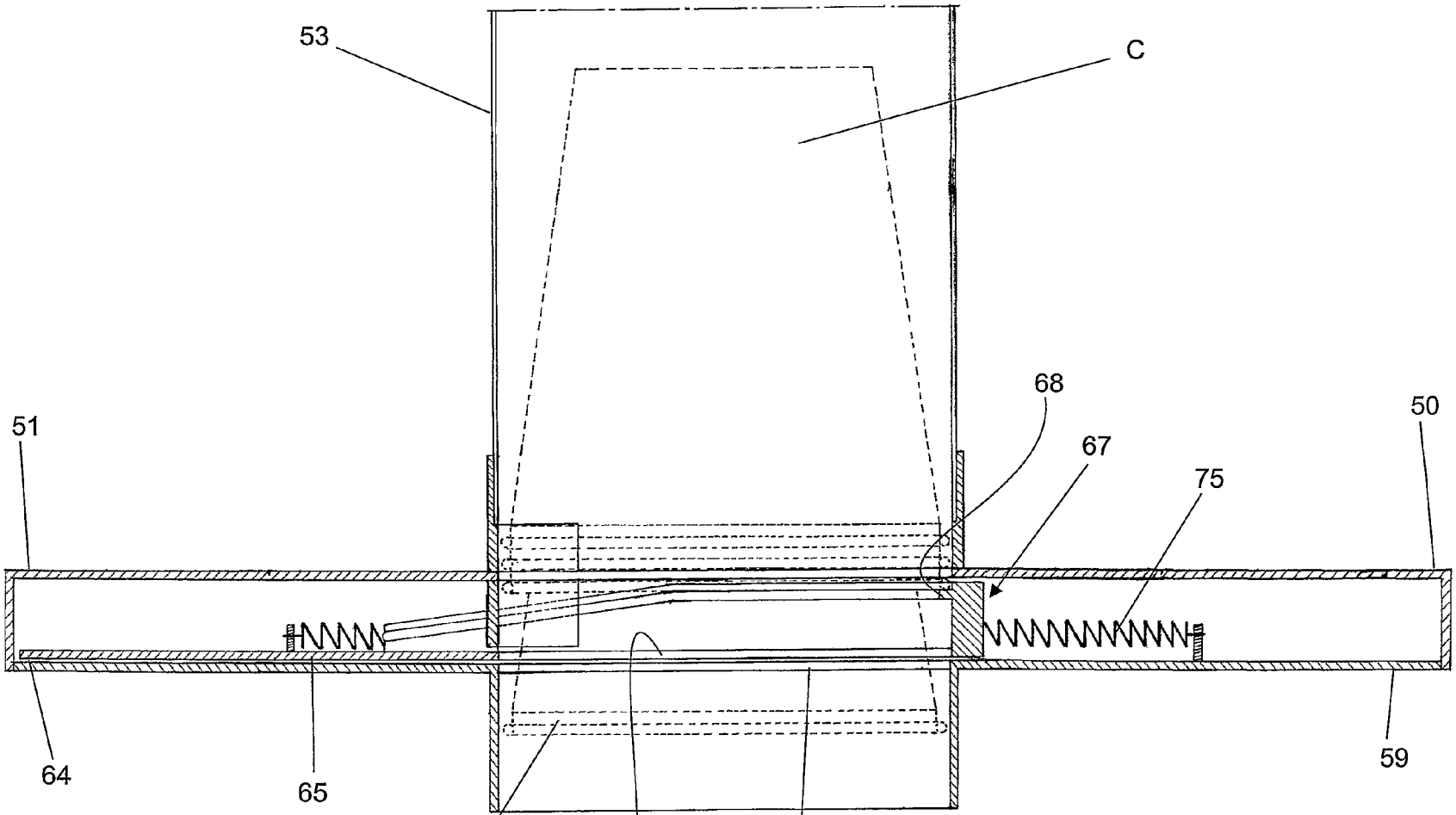
FIG. 17 is a view equal to the previous one, but, in this case the device is operated to dispense one cup.

The operation of the device according to the second preferred concretion is equally simple, according to the illustrated in FIGS. 15, 16 and 17, where the dotted lines represent the movement of the dispensed cup. But before describing this details, it is possible to observe that a stack of cups is arranged with their mouths facing downwards in the inner section of the drawer (53). In a first condition, illustrated in FIG. 10, the diaphragm plate (63) is displaced so that its blind section (65) is positioned over the opening (60). Consequently, the stack of cups (C) remains leaned against this mentioned blind section (65) of the plate (64), being hindered from moving down. To dispense one cup, the mentioned diaphragm plate (63-64) is displaced through its digital handle (73) to overcome the pressure of the springs (75) until its opening (66) becomes axially aligned with the opening (60). This movement is limited by certain construction details, mainly the slot (74). During this sliding movement of the diaphragm-plate (63), this horseshoe shaped part (67) promotes the selection or simply separates the first bottom cup (C1) from the others. In other words, the rim (68) fits itself between the first (C1) and second cup (C2) from the bottom to the top, forcing the first cup so that it releases itself from the cup immediately above (C2). In this condition, the stack of cups remains leaned against the rim (68), whilst only the first cup is positioned bellow the mentioned border (FIG. 17). But, when the alignment between the openings (66) and (60) is completed, the first cup (C1) is released to slide down and through the length of the drawer (62) by simple free fall, descending with its mouth downwards. But (FIG. 15) as it touches the peg (86), it tends to turn to the outside, making a 180.degree. turn. This occurs due to the conic shape of the mentioned cup. Its mouth, exhibiting a greater diameter, remains inside the part (62), whose inferior extremity exhibits a slight funneling, sufficient to retain the mentioned cup in the upright position, so that the user can pick it up already in the usage position. In this moment that lever (73) is not manually operated anymore and, therefore, the springs (75) make the diaphragm (63) return to its original position, the one illustrated in FIG. 16. In this position the complete inner section of the device remains adequately closed, avoiding the penetration of insects and dust. And the device will be ready for a new operation.

The invention claimed is:

1. A semi-automatic dispenser for disposable cups, comprising:

a semicircular box having a straight vertical wall facing a rear side and a curved vertical wall facing a front side, as well as an upper plate;

a fastening plate for the dispenser on the rear side;

a vertically assembled tubular drawer with a top lid, said tubular drawer forming a compartment for several disposable cups arranged upside-down, wherein the semicircular box is axially aligned with the tubular drawer;

a tubular and vertical section connected to the box and forming an exit for the cups to be dispensed, said tubular and vertical section having a bottom end that is narrower than a top end, and having a median peg that reverses a cup in the tubular and vertical section from an upside down position to an upright position;

a plate having a semicircular shape fitted underneath the semicircular box, and which closes the box;

a sliding diaphragm plate disposed above the semicircular plate and having a circular opening and a blind section;

an articulation bolt disposed at a rear edge of the sliding diaphragm plate;

an extension on a front edge of sliding diaphragm plate, said extension forming a digital handle, said extension projecting to an outside of the box through a slot in the front vertical wall of the box, said extension being dimensioned so that the diaphragm-plate can be moved from one side to another, to move the circular opening of the sliding diaphragm plate into and out of alignment with two other circular openings that exist in the upper wall of the box and in the semicircular plate, respectively, said two other openings being aligned with the tubular drawer and the tubular section, wherein the slot has a length such that the diaphragm plate can be displaced so that the blind section can be placed between the two other circular openings; and a horseshoe shaped part disposed above the diaphragm-plate, said part having tapered ends that face the blind section, and a round body that surrounds the circular opening in the diaphragm plate, said part having an internal border that is contoured by a step or advanced border, said step or advanced border separating a cup to be dispensed into an interior of the tubular section.

2. The semiautomatic dispenser according to claim 1, further comprising a spring disposed on an inner side of the box, said spring maintaining the diaphragm plate in a tensioned position so that the blind section overlaps the other two openings.

3. A semi-automatic dispenser for disposable cups, comprising:

a box having a parallelepipedal shape and a height smaller than a width, with an upper wall having a central opening and a fitting and fastening neck on a top surface and a semi-circular neck on a lower surface, which corresponds to an axial passage for the cups to be dispensed;

fastening means disposed on a rear of the box;

a tubular shelf having a top lid, said shelf forming a compartment for several disposable cups arranged upside down in form of a stack, said shelf being connected to the fitting and fastening neck;

a rectangular lid for closing a bottom section of the box, said lid having a round central opening, with one side of said opening being axially aligned with the central opening of the box, said rectangular lid having a neck that forms a passage or exit for the cups to be dispensed;

a tubular receiving shelf for dispensed cups, said receiving shelf being connected at an upper edge to the neck on the bottom plate;

a slidable diaphragm disposed in an inner section of the box, said diaphragm being formed by a elate having a blind section on one side and with an opening having a diameter corresponding to the openings in the box and bottom plate, and with a diameter of a mouth of a cup to be dispensed, wherein the blind section is adapted to be movable so that it overlaps or is outside the openings in the box and bottom plate, wherein in an overlapping position, the blind section closes the bottom plate and supports the stack of cups to be dispensed, and wherein the hole in the diaphragm is movable so that it overlaps or is outside the openings in the box and bottom plate, such that in an overlapping position of the holes with the holes in axial alignment with each other, a cup to be dispensed passes through an interior of the receiving drawer;

a horseshoe-shaped part fitted over the diaphragm and following a contour of the opening in the diaphragm opposite the semi-circular neck, so that the horseshoe-shaped part and the semi-circular opening combine to form a round passage section for the cup to be dispensed, wherein the horseshoe-shaped part has cooperative internal means that separate a first bottom cup while retaining the other cups when the diaphragm is moved to align the openings in the box, bottom plate and diaphragm, wherein the horseshoe-shaped part has branches that are parallel to one another and joining with a curved or semi-circular central section, wherein the central section and the branches have coplanar bottom faces, wherein the branches have upper faces that are inclined downward toward their ends, wherein an inner face of the horseshoe shaped part have means for separation of the cups, said means comprising a rim or groove having a horizontal portion extending along a curve of the central section and an inclined section that extends along the branches, following an angle of inclination of the upper face of the branches, so that the ends of the horseshoe-shaped part can remain aligned to penetrate into a space between rounded borders of a first cup and a second cup, and wherein the diaphragm is adapted to be moved so that the inclination of the rim or groove in the branches is sufficient to separate first cup from the second cup and liberate the first cup through the passage while other cups are retained against the means for separation of the cups.

4. A semiautomatic dispenser for disposable cups, comprising:

a box having a parallelepipedal shape and a height smaller than a width, with an upper wall having a central opening and a fitting and fastening neck on a top surface and a semi-circular neck on a lower surface, which corresponds to an axial passage for the cups to be dispensed;

fastening means disposed on a rear of the box;

a tubular shelf having a top lid, said shelf forming a compartment for several disposable cups arranged upside down in form of a stack, said shelf being connected to the fitting and fastening neck;

a rectangular lid for closing a bottom section of the box, said lid having a round central opening, with one side of said opening being axially aligned with the central opening of the box, said rectangular lid having a neck that forms a passage or exit for the cups to be dispensed;

a tubular receiving shelf for dispensed cups, said receiving shelf being connected at an upper edge to the neck on the bottom plate;

a slidable diaphragm disposed in an inner section of the box, said diaphragm being formed by a plate having a blind section on one side and with an opening having a diameter corresponding to the openings in the box and bottom plate, and with a diameter of a mouth of a cup to be dispensed, wherein the blind section is adapted to be movable so that it overlaps or is outside the openings in the box and bottom plate, wherein in an overlapping position, the blind section closes the bottom elate and supports the stack of cups to be dispensed, and wherein the hole in the diaphragm is movable so that it overlaps or is outside the openings in the box and bottom plate, such that in an overlapping position of the holes with the holes in axial alignment with each other, a cup to be dispensed passes through an interior of the receiving drawer;

a horseshoe-shaped part fitted over the diaphragm and following a contour of the opening in the diaphragm opposite the semi-circular neck, so that the horseshoe-shaped part and the semi-circular opening combine to form a round passage section for the cup to be dispensed, wherein the horseshoe-shaped part has cooperative internal means that separate a first bottom cup while retaining the other cups when the diaphragm is moved to align the openings in the box, bottom plate and diaphragm, wherein an upper end of the receiving shelf has a tubular shape and is connected to the semicircular neck, and has a semi-circular longitudinal cut, wherein the receiving shelf further comprises a median peg in an inner section thereof, wherein the receiving shelf has a radius sufficient to maintain a cup imprisoned within the shelf while a bottom of the cup, having a smaller diameter, is launched outside the shelf, when the cup touches the median peg, the peg causing the cup to rotate 180° and is maintained in a lower section of the receiving shelf, the receiving shelf having a lower edge with a diameter smaller than a largest diameter of the cup so that the cup is maintained fixed with its rim in the lower edge of the shelf until removal by a user.

* * * * *